US012674114B2

(12) United States Patent
Deo et al.

(10) Patent No.: US 12,674,114 B2
(45) Date of Patent: Jul. 7, 2026

(54) LUBRICANT COMPOSITIONS INCLUDING A POLYMERIZABLE-ACID GRAFT POLYMER AS A CORROSION INHIBITOR

(71) Applicant: Dow Global Technologies LLC, Midland, MI (US)

(72) Inventors: Puspendu Deo, Pearland, TX (US); Sean Ewart, Pearland, TX (US); Cathi Evans-Beatty, Clute, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 18/881,059

(22) PCT Filed: Jul. 7, 2023

(86) PCT No.: PCT/US2023/069751
§ 371 (c)(1),
(2) Date: Jan. 3, 2025

(87) PCT Pub. No.: WO2024/011204
PCT Pub. Date: Jan. 11, 2024

(65) Prior Publication Data

US 2026/0002089 A1 Jan. 1, 2026

Related U.S. Application Data

(60) Provisional application No. 63/359,586, filed on Jul. 8, 2022.

(51) Int. Cl.
*C10M 169/04* (2006.01)
*C10N 40/30* (2006.01)

(52) U.S. Cl.
CPC ..... *C10M 169/041* (2013.01); *C10M 2203/1006* (2013.01); *C10M 2209/02* (2013.01); *C10N 2040/30* (2013.01)

(58) Field of Classification Search
CPC ..... C10M 169/041; C10M 2203/1006; C10M 2209/02; C10N 2040/30
See application file for complete search history.

(56) References Cited

U.S. PATENT DOCUMENTS 4,294,853 A 10/1981 Williams et al.
4,528,334 A 7/1985 Knopf et al.
(Continued)

FOREIGN PATENT DOCUMENTS

BR PI9816180 B1 9/2018
CN 104293443 A 1/2015
(Continued)

OTHER PUBLICATIONS

International Search Report and Written Opinion dated Oct. 6, 2023, pertaining to Int'l Patent Application No. PCT/US2023/069684, 11 pgs.
(Continued)

*Primary Examiner* — Taiwo Oladapo
(74) *Attorney, Agent, or Firm* — Dinsmore & Shohl LLP

(57) ABSTRACT

Embodiments of lubricant compositions that may comprise a lubricant oil and a corrosion inhibitor, wherein the corrosion inhibitor may comprise a polymerizable-acid graft polymer that may comprise from about 3.0% to about 35% by weight of an unsaturated grafting acid and an alkylene oxide polymer backbone, the alkylene oxide polymer backbone having the formula: $R''—[(OC_nH_{2n})_z—OR']_a$ wherein each R' in the formula may be independently selected from the group consisting of a hydrogen atom, hydrogen radicals, and acyl radicals, wherein each R" in the formula may be independently selected from the group consisting of a hydrogen atom, hydrogen radicals, amine-containing radicals, and acyl radicals, wherein each "n" in the formula may independently have a value of from 2 to 4, wherein each "Z" in the formula may independently have a value of from 4 to
(Continued)

about 1800, and wherein "a" may have a value of from 1 to 4.

17 Claims, 1 Drawing Sheet

(56) References Cited

U.S. PATENT DOCUMENTS

| | | | |
|---|---|---|---|
| 5,578,557 | A | 11/1996 | Dougan et al. |
| 7,018,959 | B2 | 3/2006 | McCullough et al. |
| 8,227,398 | B2 | 7/2012 | Kany et al. |
| 2011/0217537 | A1 | 9/2011 | Fantinel et al. |
| 2019/0352439 | A1 | 11/2019 | Xu et al. |
| 2020/0277544 | A1 | 9/2020 | Ewart et al. |
| 2021/0054178 | A1 | 2/2021 | Tso et al. |
| 2022/0234341 | A1 | 7/2022 | Zhang et al. |

FOREIGN PATENT DOCUMENTS

| | | | | | |
|---|---|---|---|---|---|
| CN | 112048358 | A | * | 12/2020 | ..... C10M 169/044 |
| CN | 114644953 | A | | 6/2022 | |
| EP | 0025125 | A1 | | 3/1981 | |
| EP | 1761966 | B1 | | 4/2011 | |
| WO | WO-9720901 | A1 | * | 6/1997 | ..... C23F 11/08 |
| WO | 2006045501 | A1 | | 5/2006 | |
| WO | 2012142396 | A1 | | 10/2012 | |

OTHER PUBLICATIONS

International Search Report and Written Opinion dated Sep. 29, 2023, pertaining to Int'l Patent Application No. PCT/US2023/069751, 11 pgs.

Zhang et al., Macromolecules 2006, 39, 8517-8525.

* cited by examiner

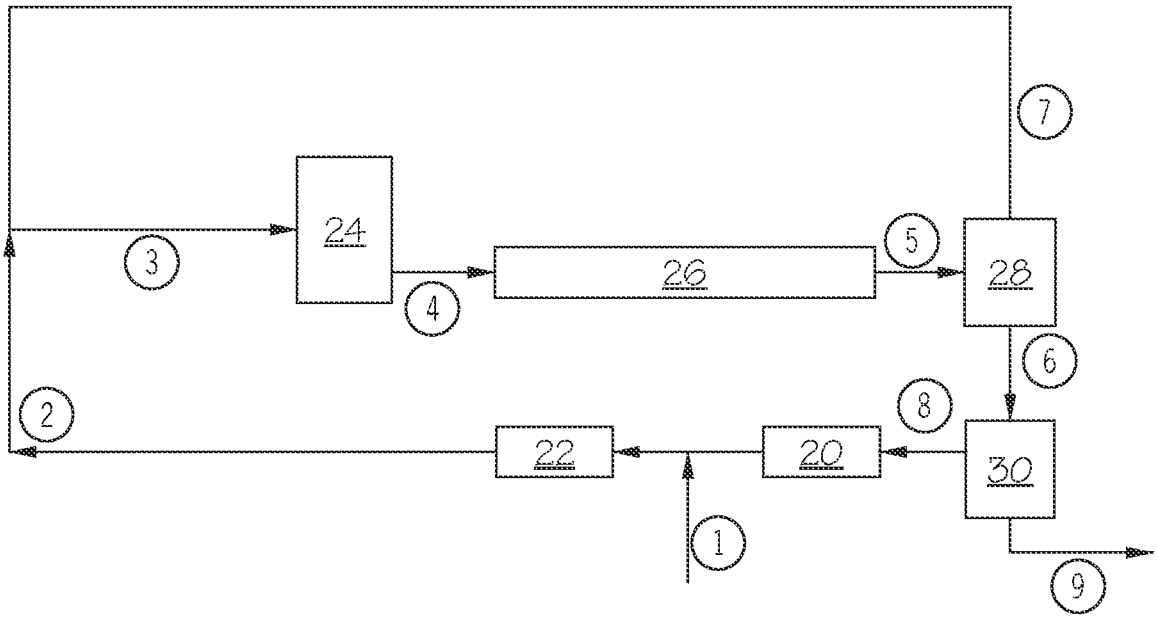
7
24
3
26
5
28
4
6
2
8
22
20
30
1
9

LUBRICANT COMPOSITIONS INCLUDING A POLYMERIZABLE-ACID GRAFT POLYMER AS A CORROSION INHIBITOR

CROSS-REFERENCE TO RELATED APPLICATIONS

This application is a National Phase Entry under 35 U.S.C. § 371 of International Patent Application No. PCT/US2023/069751 filed Jul. 7, 2023, which claims priority to U.S. Provisional Application Ser. No. 63/359,586 filed Jul. 8, 2022, which are hereby incorporated by reference in their entirety.

TECHNICAL FIELD

Embodiments described herein generally relate to corrosion inhibition and, more specifically, to lubricant compositions with corrosion inhibitors.

BACKGROUND

Acid Copolymer Resins (ACR) may be used to produce packing materials, building panels, and water pipes, among other things. As a result of this utility there is a worldwide demand for ACRs. ACR production often involves the use of corrosive materials. Over time these corrosive materials can corrode the components of an ACR-producing train requiring the replacement of these components. The replacement of these components may increase the cost of ACR production. Therefore, there is a need for improvement in the production of ACR, and more specifically there is a need for improvement in the protection of the ACR-producing train from the effects of corrosion.

SUMMARY

Embodiments of the present disclosure meet this need by utilizing the present polymerizable-acid graft polymers in the lubricant composition.

According to one or more embodiments of the present disclosure, a lubricant composition is provided. The lubricant composition comprises: an oil lubricant and a corrosion inhibitor comprising a polymerizable-acid graft polymer comprising from about 3.0% to about 35% by weight of an unsaturated grafting acid and an alkylene oxide polymer backbone, the alkylene oxide polymer backbone having the following formula:

$$R''\text{—}[(OC_nH_{2n})_z\text{—}OR']_a$$

wherein each R' is independently selected from the group consisting of a hydrogen atom, hydrogen radicals, and acyl radicals; wherein R" is independently selected from the group consisting of a hydrogen atom, hydrogen radicals, amine-containing radicals, and acyl radicals; wherein each "n" has, independently, a value of from 2 to 4; wherein each "Z" has, independently, a value of from 4 to about 1800; and wherein "a" has a value of from 1 to 4.

Additional features and advantages will be set forth in the detailed description which follows, and in part will be readily apparent to those skilled in the art from that description or recognized by practicing the embodiments described herein, including the drawings, the detailed description that follows and the claims.

BRIEF DESCRIPTION OF THE DRAWINGS

FIG. 1 schematically depicts a reactor system, according to one or more embodiments of the present disclosure.

When describing the simplified schematic illustration of FIG. 1, the numerous valves, temperature sensors, electronic controllers, and the like, which may be used and are well known to a person of ordinary skill in the art, are not included. However, it should be understood that these components are within the scope of the present disclosure.

Reference will now be made in greater detail to various embodiments, some of which are illustrated in the accompanying drawing.

DETAILED DESCRIPTION

Specific embodiments of the present application will now be described. The disclosure may, however, be embodied in different forms and should not be construed as limited to the embodiments set forth in this disclosure. Rather, these embodiments are provided so that this disclosure will be thorough and complete, and will fully convey the scope of the subject matter to those skilled in the art.

The present disclosure is directed to lubricant compositions. For example, and as described herein, a lubricant composition may include a lubricant oil and a corrosion inhibitor. The corrosion inhibitor may comprise a polymerizable-acid graft polymer comprising from about 3.0% to about 35% by weight of an unsaturated grafting acid and an alkylene oxide polymer backbone. The alkylene oxide polymer backbone may have the formula:

$$R''\text{—}[(OC_nH_{2n})_z\text{—}OR']_a$$

Each R' in the formula may be independently selected from the group consisting of a hydrogen atom, hydrogen radicals, and acyl radicals. Each R" in the formula may be independently selected from the group consisting of a hydrogen atom, hydrogen radicals, amine-containing radicals, and acyl radicals. Each "n" in the formula may independently have a value of from 2 to 4. Each "Z" in the formula may independently have a value of from 4 to about 1800. In the formula "a" may have a value of from 1 to 4.

The term "polymerizable-acid graft polymer" as used herein refers to segmented copolymers comprising a linear backbone polymer and randomly distributed branches of another acid polymer. The linear backbone polymer can be a poly(alkylene oxide) compound. Poly(alkylene oxide) compounds can be produced by reacting an alkylene oxide or a mixture of alkylene oxides, added sequentially or in combination, with an alcohol. Such alcohols can be monohydric or polyhydric and correspond to the formula R" (OH) a, wherein R" is selected from the group consisting of a hydrogen atom, hydrogen radicals, amine-containing radicals and acyl radicals, and "a" has a value of from 1 to 4. Such alcohols may include methanol, ethanol, propanol, butanol, ethylene glycol, glycerol, the monoethyl ether of glycerol, the dimethyl ether of glycerol, sorbitol, 1,2,6-hexanetriol, trimethylolpropane, other alcohols with the corresponding formula are contemplated herein. The grafting of the polymerizable acid monomer onto the poly (oxyalkylene) compounds to form the polymerizable-acid graft polymer can be carried out by free radical polymerization.

In one or more embodiments, the lubricant composition may comprise an oil lubricant. The oil lubricant may comprise at least one oil, and may contain one or more additives, for example, one or more lubrication agents. Additives may be added to improve lubricity, flow properties, thermal stability, and/or other properties. In one or more embodiments the at least one oil may be a viscous liquid with increased viscosity, as compared to that of water at the same temperature and pressure, and which is derived from petroleum. The at least one oil may provide lubrication and reduced friction between moving surfaces of rotational and/or reciprocating mechanisms. In one or more embodiments, the oil may be one or more mineral oils and polyalkylene glycol base oils.

In some embodiments, the oil may have a kinematic viscosity at 40° C. of from 50 $mm^2/s$ to 200 $mm^2/s$. For example, the oil may have a kinematic viscosity of from 50 $mm^2/s$ to 100 $mm^2/s$, from 100 $mm^2/s$ to 150 $mm^2/s$, from 150 $mm^2/s$ to 200 $mm^2/s$, or any combination of these ranges.

As described herein, in one or more embodiments, the lubricant composition may comprise a corrosion inhibitor. In some embodiments the lubricant composition may comprise a corrosion inhibitor in an amount from 0.5 wt. % to about 20 wt. %. For example, the lubricant composition may comprise a corrosion inhibitor in an amount from 0.5 wt. % to 1 wt. %, from 1 wt. % to 5 wt. %, from 5 wt. % to 10 wt. %, from 10 wt. % to 15 wt. %, from 15 wt. % to 20 wt. %, or any combination of these ranges. In some embodiments, the lubricant composition may comprise a corrosion inhibitor in an amount from 1 wt. % to 17.5 wt. %, from 1.5 wt. % to 15 wt. %, from 2 wt. % to 12.5 wt. %, or from 2.5 wt. % to 10 wt. %. In some embodiments, the lubricant composition may comprise a polymerizable-acid graft polymer, as described herein, in an amount from 2.5 wt. % to 10 wt. %.

In one or more embodiments, the corrosion inhibitor may comprise the polymerizable-acid graft polymer described above. As stated above, the alkylene oxide polymer backbone may have the following formula:

$$R''-[(OC_nH_{2n})_z-OR']_a$$

Each R' may be independently selected from the group consisting of a hydrogen atom, hydrogen radicals, and acyl radicals. R" may be independently selected from the group consisting of a hydrogen atom, hydrogen radicals, amine-containing radicals, and acyl radicals. Each "n" may have, independently, a value of from 2 to 4. Each "Z" may have, independently, a value of from about 4 to about 1800. In the formula, "a" may have a value of from 1 to 4. In some embodiments, the lubricant composition may comprise a corrosion inhibitor, wherein R' and R" are not both a hydrogen atom. In one or more embodiments, "n" is 2 or 3, "a" has a value of 1, R' and R" are selected from the group consisting of a hydrogen atom, hydrogen radicals, and acyl radicals In one embodiment the alkylene oxide polymer backbone is either an ethylene oxide ("EO") polymer or propylene oxide ("PO") polymer.

In another embodiment, the corrosion inhibitor may comprise an alkylene oxide polymer backbone selected from the group consisting of oxyethylene ("EO") and oxypropylene ("PO").

In one or more embodiments, the alkylene oxide polymer backbone is a co-polymer of EO and PO polymers having a weight ratio of from about 0:100 to about 100:0 of EO:PO. For example, the alkylene oxide polymer backbone is a co-polymer of EO and PO polymers having a weight ratio of about of about 0:100 of EO:PO, of about 10:90 of EO:PO, of about 20:80 of EO:PO, of about 30:70 of EO:PO, of about 40:60 of EO:PO, of about 50:50 of EO:PO, of about 60:40 of EO:PO, of about 70:30 of EO:PO, of about 80:20 of EO:PO, of about 90:10 of EO:PO, or of about 100:0 of EO:PO. In some embodiments, the alkylene oxide polymer backbone that is a co-polymer of EO and PO polymers having a weight ratio from about 90:10 to about 10:90 of EO:PO, or from about 75:25 to about 25:75 of EO:PO.

In one or more embodiments, the polymerizable-acid graft polymer may have an average molecular weight of between approximately 1500 Daltons and approximately 80000 Daltons. For example, the polymerizable-acid graft polymer may have an average molecular weight of between approximately 1500 Daltons and approximately 5000 Daltons, of between approximately 5000 Daltons and approximately 10000 Daltons, of between approximately 10000 Daltons and approximately 20000 Daltons, of between approximately 20000 Daltons and approximately 30000 Daltons, of between approximately 30000 Daltons and approximately 40000 Daltons, of between approximately 40000 Daltons and approximately 50000 Daltons, of between approximately 50000 Daltons and approximately 60000 Daltons, of between approximately 60000 Daltons and approximately 70000 Daltons, of between approximately 70000 Daltons and approximately 80000 Daltons, or any combination of these ranges. In some embodiments, the polymerizable-acid graft polymer may have an average weight of between approximately 1500 Daltons and approximately 20000 Daltons.

As is disclosed herein, in one or more embodiments, the polymerizable-acid grafted polymer may comprise from about 3.0% to about 35% by weight of an unsaturated grafting acid. For example, the polymerizable-acid grafted polymer may comprise from about 3.0% to about 5.0% by weight, from about 5.0% to about 10% by weight, from about 10% to about 15% by weight, from about 15% to about 20% by weight, from about 20% to about 25% by weight, from about 25% to about 30% by weight, from about 30% to about 35% by weight, or any combination of these ranges. In some embodiments, the polymerizable-acid grafted polymer may comprise from about 4.0% to about 30% by weight, or from about 5.0% to about 25% by weight. Without being bound by theory, it was surprisingly found that this grafting level correlated to increased corrosion resistance, as described further below.

In one or more embodiments, the unsaturated grafting acid may be chosen from one or more of acrylic acid, methacrylic acid, itaconic acid, maleic acid, 2-acrylamido-2-methylpropylsulfonic acid (AMPS), 2-methacrylamido-2-methylpropylsulfonic acid, styrene sulfonic acid, vinylsulfonic acid, ethylene glycol methacrylate phosphate, vinyl phosphonic acid, and mixtures thereof.

In one or more embodiments, the corrosion inhibitor may comprise an polymerizable-acid graft polymer, wherein the grafting acid is acrylic acid and the alkylene oxide polymer backbone is poly(oxyethylene-oxypropylene) having a weight ratio of oxyethylene to oxypropylene of 50:50.

In one or more embodiments, the corrosion inhibitor may be an acrylic acid grafted ethylene oxide-propylene oxide copolymer. For example, the corrosion inhibitor may be UCON™ EPML-483 from Dow.

In one or more embodiments, the lubricant composition may be used in a method to reduce corrosion comprising exposing a metal component to a solution containing the lubricant composition and (meth)acrylic acid, wherein the lubricant composition reduces metal corrosion. As used in the present disclosure, the term "(meth)acrylic acid" can be used to refer to either methacrylic acid, or acrylic acid, or both.

In one or more embodiments, the solution containing the lubricant composition may comprise a co-solvent. The co-solvent may comprise a carboxylic acid, an alcohol, or combinations thereof. In some embodiments, the co-solvent may comprise methanol.

As stated above, the lubricant composition may be used to resist corrosion for metal components. In one or more embodiments, the metal component may comprise bronze packing rings. In one or more embodiments the bronze packing rings may be a part of a compressor. In some embodiments the bronze packing rings may be a part of a compressor unit utilized in a high pressure polymerization reactor, such as the one depicted schematically in FIG. 1

In one or more embodiments, the lubricant composition may be used in a free radical polymerization process comprising polymerizing ethylene monomer and optionally (meth)acrylic acid in the presence of the lubricant composition via free radical polymerization in a high pressure polyethylene reactor having a compressor with bronze packing rings. A free radical polymerization process, for the production of an ethylene-based polymer, is usually carried out at an elevated pressure, typically at least 100 MPa. For example, the free radical polymerization process may be carried out at least 200 MPa, at least 300 MPa, at least 400 MPa, or at least 500 MPa The following definitions may be helpful in understanding the operation of an example reactor system that may be suitable for use with the lubricant compositions described herein.

The terms "feed" or "feed stream," as used herein, refer to fresh and/or recycled reactant(s) added to a reaction zone at an inlet to the reaction zone.

The term "reaction zone," as used herein, refers to a reactor zone where polymerization reaction is initiated or reinitiated by the addition of free radicals and/or the decomposition of components into free radicals or components which generate free radicals.

The term "reactor system," as used herein, refers to the components (devices) used to polymerize and isolate a polymer. Such components/devices include, but are not limited to, one or more reactors, a Hyper-compressor, a Primary compressor, and a Booster compressor. A reactor system typically comprises at least one reactor, for example tubular reactor(s), autoclave reactor(s), or any combination thereof.

The term "injection point," as used herein, refers to the inlet location of a device (used in a polymerization process) where a feed stream is added into the device.

The term "pressurizing," as used herein, refers to increasing the pressure of a liquid or feed to a higher pressure level.

The term "compression system," as used herein, refers to a compression device, which increases the pressure of a vapor (for example, ethylene vapor below or above its critical point) to a higher pressure level. Feeding a comonomer could include pressurizing and feeding the reactive comonomer with an ultra-high pressure reciprocating plunger pump, directly to a reactor zone and/or to a feed stream to the reaction zone, and/or feeding the comonomer by a combination of pressurizing with a high pressure pump, and further compressing through reciprocating plunger compressors (for example, Hyper-compressor, Primary compressor and/or Booster compressor).

The term "compression," as used herein, refers to increasing the pressure of a vapor (for example, ethylene vapor below or above its critical point) to a higher pressure level.

The booster compressor is a device that compresses, for example, the low pressure recycle coming from the low pressure separator to the pressure level required at the inlet side of the primary compressor. This compression can take place in one or multiple compression stages, and can be combined with intermediate cooling. The booster compressor can consist of single or multiple compressor frames, and can be potentially combined with primary compressor frame(s).

The primary compressor is a device that compresses, for example, the following: a) the fresh incoming ethylene, and/or b) the low pressure recycle coming from the booster compressor; each to the pressure level required at the inlet side of the hyper-compressor. This compression can take place in one or multiple compression stages, and can be combined with intermediate cooling. The primary compressor can consist of single or multiple compressor frames, and can be potentially combined with booster compressor frame(s).

The hyper-compressor, or secondary compressor, is a device that compresses, for example, the monomer coming from the primary compressor to a pressure level required to feed the reactor at its inlet pressure set point. This compression can take place in one or multiple compression stages, and can be combined with intermediate cooling. The hyper-compressor typically comprises a plunger reciprocating compressor, and can consist of single or multiple compressor frame(s).

Now referring to FIG. 1, an example reactor system that may be suitable for use with the lubricant compositions described herein is schematically depicted. It should be understood that not all portions of FIG. 1 should be construed as essential to the claimed subject matter. Moreover, while the lubricant compositions in the appended claims are described herein in the context of FIG. 1, such recited compositions should be understood as adaptable to other systems, as would be understood by those skilled in the art.

FIG. 1. shows a generalized flow schematic of a high pressure polymerization process with a reactor system containing a reactor 26 which may be a tubular reactor, an autoclave reactor, or combination of both tubular and autoclave reactors. Stream (1) represents the fresh monomer make-up, which is compressed, together with the outlet of the booster compressor (20), by the primary compressor (22), to stream (2). The fresh monomer make-up may comprise ethylene. Stream (2) is combined with the high pressure recycle stream (7) from the high pressure separator (28) in the hyper-compressor inlet stream (3), and fed to the suction inlet(s) of the Hyper-compressor (24). The hyper-compressor compresses the monomer feed streams to a level sufficient to feed to the reactor (26). Stream 4 represent the compressed monomer feed streams which are fed to the reactor (26). The high-pressure separator (28) separates the product steam (5) into a polymer-rich stream (6) and an unreacted monomer-rich stream (7). Stream (7) is recycled to use again in the process and stream (6) is taken to the low-pressure separator (30). Low pressure separator (30) separates steam (6) into monomer stream (8) which flows to the booster compressor (20), and polymer stream (9) which is taken for further processing.

In one or more embodiments, the lubricant composition as described herein may be utilized in the Hyper-compressor (Hyper). For example, the lubricant composition may be exposed to the metal components of the Hyper-compressor (Hyper). In some embodiments, the metal components of the Hyper-compressor (Hyper) may comprise bronze packing rings.

Test Methods

Corrosion Testing

Corrosion testing was conducted using 936-bearing bronze coupons with a density of 8.8 g/cm$^3$ at 20° C. The bronze coupons were cut to a diameter of 1.27 cm and a thickness of 0.32 cm. The testing was done in a glove box and reagents were degassed and dried as necessary before being brought into the glove box. All experiments were repeated 5 times and the average was reported. The premeasured coupons were added to 40 ml vials with pressure relief caps. The reagents were then added to the vials and the pressure relief caps were secured. The vials were then removed from the glove box and pictures were taken of the vials. The vials were then placed inside a heating block and heated at 100° C. for 2 weeks. After 2 weeks the vials were removed from the heating block and allowed to cool. When the vials had cooled to room temperature the coupons were removed from the vial using tweezers and laid out on a chemwipe. The coupons were rinsed with tetradecane over a metal pan and wiped off completely with a metal spatula. The flat end of the spatula was used at about a 30° angle to scrape off any corrosion or build up on the surface of the coupon. Care was taken to not apply maximum pressure to the coupon during scraping to avoid gouging the surface of the coupon. The coupons were rinsed with clean tetradecane and wiped with a chemwipe. The cleaned coupons were each placed in separate 20 ml vials. The vials with the cleaned coupons were placed in a vacuum oven overnight at 160° C. to dry. The dry coupons were then weighed. The difference between the dry coupon weight and the starting coupon weight was measured and recorded.

Corrosion Rate

Corrosion rate was measured using the formula below: where weight loss is the difference between the dry coupon weight and the starting coupon weight, the alloy density is 8.8 g/cm$^3$, the exposed area of the coupons was measured by considering the coupons as cylinders and the exposed area was calculated as that of a cylinder. The coupons had a diameter of 1.27 cm and a thickness of 0.32 cm for an exposed area of 3.86 cm$^2$, the exposure time is 336 hours, and K is the K-factor. The alloy density and the K-factor values were gathered from the literature.

$$\text{Corrosion Rate } (CR) = \frac{\text{Weight Loss(g)} * K}{\text{Alloy Density}\left(\frac{\text{g}}{\text{cm}^3}\right) * \text{Exposed Area}(A) * \text{Exposure Time}(hr)} \quad \text{(Eq. 1)}$$

Corrosion Inhibition

Corrosion inhibition was measured using the following formula to calculate the percent of corrosion inhibition. The corrosion rate uninhibited was calculated from the corrosion rate of the coupon with no inhibitor present. The corrosion rate inhibited was calculated from the corrosion rate of the coupon with an added inhibitor.

$$\text{Corrosion Inhibition \%} = \frac{\text{Corrosion rate uninhibited} - \textit{Corrrosion} \text{ rate inhibited}}{\text{Corrosion rate uninhibited}} * 100 \quad \text{(Eq. 2)}$$

Examples

Embodiments will be further clarified by the following examples.

TABLE 1

Materials Added for Corrosion Inhibition Tests

| Experiment # | Experiment | Hydrobrite 380, g | Methanol, g | Methacrylic acid, g | Inhibitor, g |
|---|---|---|---|---|---|
| A | No inhibitor | 7.2 | 0.8 | 4.8 | 0 |
| 2 | Inhibitor: 2.5% EPML 483 | 7.02 | 0.8 | 4.8 | 0.18 |
| 3 | Inhibitor: 5% EPML 483 | 6.84 | 0.8 | 4.8 | 0.36 |
| 4 | Inhibitor: 10% EPML 483 | 6.48 | 0.8 | 4.8 | 0.72 |
| B | Inhibitor: 5% 50-HB-5100 | 6.84 | 0.8 | 4.8 | 0.36 |

Table 1 shows the compositions of the lubricant compositions which were tested for their corrosion inhibition performance. Corrosion inhibitor tests were run with a formulation having lubricant oil, methanol, methacrylic acid, and optionally a corrosion inhibitor. The formulation components were mixed at room temperature. The lubricant oil used was Hydrobrite 380 which is a commonly available white mineral oil produced by Sonneborn. The inhibitors used were UCON™ EPML 483, which is an acrylic acid grafted ethylene oxide-propylene oxide copolymer, and UCON™ 50-HB-5100, which is a non-grafted ethylene oxide-propylene oxide copolymer. Both UCON™ EPML 483 and UCON™ 50-HB-5100 are commercially available from Dow Inc., Midland, MI. The amount of inhibitor added in each experiment was calculated as a weight percentage of the Hydrobrite 380 lubricant oil.

TABLE 2

Corrosion Testing Results

| Experiment # | Experiment | Coupon type | Alloy density g/cm$^3$ | Exposed area (cm$^2$) | K factor | Exposure time (hr) | Average weight loss (g) |
|---|---|---|---|---|---|---|---|
| A | No Inhibitor | Bronze-Lead | 8.8 | 3.86 | $3.45 \times 10^6$ | 336 | 0.0405 |
| 2 | Inhibitor: 2.5% EPML 483 | Bronze-Lead | 8.8 | 3.86 | $3.45 \times 10^6$ | 336 | 0.0057 |
| 3 | Inhibitor: 5% EPML 483 | Bronze-Lead | 8.8 | 3.86 | $3.45 \times 10^6$ | 336 | 0.0045 |
| 4 | Inhibitor: 10% EPML 483 | Bronze-Lead | 8.8 | 3.86 | $3.45 \times 10^6$ | 336 | 0.0039 |
| B | Inhibitor: 5% 50-HB-5100 | Bronze-Lead | 8.8 | 3.86 | $3.45 \times 10^6$ | 336 | 0.04022 |

TABLE 3

Percentage Corrosion Inhibition

| Experiment # | Experiment | Corrosion rate mils/year (mpy) | % Corrosion inhibition |
|---|---|---|---|
| A | No inhibitor | 12.25 | 0 |
| 2 | Inhibitor: 2.5% EPML 483 | 1.72 | 85.9 |
| 3 | Inhibitor: 5% EPML 483 | 1.35 | 88.9 |
| 4 | Inhibitor: 10% EPML 483 | 1.18 | 90.4 |
| B | Inhibitor: 5% 50-NB-5100 | 12.15 | 0.8 |

Referring to the corrosion inhibition results in Tables 2 and 3, Experiments with EPML 483 (i.e., Experiments 2-4) show significantly less corrosion than the Comparative Examples without EPML 483, such as Comparative Examples A and B. Additionally Tables 2 and 3 indicate that corrosion inhibition increased with increasing quantity of EPML 483 up to 10%. Put simply, Tables 2 and 3 indicate that EPML 483 showed excellent corrosion inhibition against methanol and methacrylic acid when combined with lubricant oil. Further, Tables 2 and 3 indicate that the addition of non-grafted ethylene oxide-propylene oxide copolymer, such as in Comparative Example B, did not have a significant impact on the corrosion inhibition performance of the lubricant composition. This indicates that the acid grafting of the ethylene oxide-propylene oxide copolymer improved the copolymer's corrosion inhibiting properties.

In a first aspect of the present disclosure, a lubricant composition may comprise an oil lubricant and a corrosion inhibitor comprising a polymerizable-acid graft polymer comprising from about 3.0% to about 35% by weight of an unsaturated grafting acid and an alkylene oxide polymer backbone, the alkylene oxide polymer backbone having the formula $$R''\text{—}[(OC_nH_{2n})_z\text{—}OR']_a,$$

where each R' is independently selected from the group consisting of a hydrogen atom, hydrogen radicals, and acyl radicals, each R" is independently selected from the group consisting of a hydrogen atom, hydrogen radicals, amine-containing radicals, and acyl radicals, each "n" has, independently, a value of from 2 to 4, each "Z" has, independently, a value of from 4 to about 1800, and where "a" has a value of from 1 to 4.

A second aspect of the present disclosure may include the first aspect where R' and R" are not both a hydrogen atom.

A third aspect of the present disclosure may include any of the previous aspects, where the grafting acid is selected from the group consisting of acrylic acid, methacrylic acid, itaconic acid, maleic acid, 2-acrylamido-2-methylpropylsulfonic acid (AMPS), 2-methacrylamido-2-methylpropylsulfonic acid, styrene sulfonic acid, vinylsulfonic acid, ethylene glycol methacrylate phosphate, vinyl phosphonic acid and mixtures thereof.

A fourth aspect of the present disclosure may include any of the previous aspects, where "n"=2 or 3, where "a" has a value of 1, where each R' or R" independently selected from the group consisting of a hydrogen atom, hydrogen radicals, and acyl radicals, and where the alkylene oxide polymer backbone is either an ethylene oxide ("EO") or propylene oxide ("PO") polymer.

A fifth aspect of the present disclosure may include any of the previous aspects, where the alkylene oxide polymer backbone is selected from the group consisting of oxyethylene ("EO") and oxypropylene ("PO").

A sixth aspect of the present disclosure may include any of the previous aspects, where the alkylene oxide polymer backbone is a copolymer of EO and PO polymers having a weight ratio of from about 0:100 to about 100:0 of EO:PO, or from about 90:10 to about 10:90 of EO:PO, or from about 75:25 to about 25:75 of EO:PO.

A seventh aspect of the present disclosure may include any of the previous aspects, where the polymer has an average molecular weight between approximately 1500 Daltons and approximately 80000 Daltons.

An eighth aspect of the present disclosure may include any of the previous aspects, where the grafting acid is acrylic acid (10 wt. %), and the alkylene oxide polymer backbone is poly(oxyethylene-oxypropylene) having a weight ratio of oxyethylene ("EO") to oxypropylene ("PO") of 50:50.

A ninth aspect of the present disclosure may include any of the previous aspects, where the oil lubricant comprises mineral oil.

A tenth aspect of the present disclosure may include any of the previous aspects, where the lubricant composition comprises from 0.5 wt. % to 20 wt. % corrosion inhibitor, or from 2.5 wt. % to 10 wt. % corrosion inhibitor.

An eleventh aspect of the present disclosure may include a method for reducing corrosion comprising exposing a metal component to a solution comprising the lubricant composition of any of the previous aspects and (meth) acrylic acid, wherein the lubricant composition reduces metal corrosion.

A twelfth aspect of the present disclosure may include the eleventh aspect, where the solution may comprise co-solvent.

A thirteenth aspect of the present disclosure may include the twelfth aspect, where the co-solvent comprises carboxylic acid, alcohol, or combinations thereof.

A fourteenth aspect of the present disclosure may include the thirteenth aspect, where the alcohol comprises methanol.

A fifteenth aspect of the present disclosure may include the twelfth to fourteenth aspects, where the metal component comprises bronze packing rings.

A sixteenth aspect of the present disclosure may include the fifteenth aspect, where the bronze packing rings are part of a compressor.

A seventeenth aspect of present disclosure may include the sixteenth aspect, where the bronze packing rings are part of a compressor unit utilized in a high pressure polyethylene reactor.

An eighteenth aspect of the present disclosure may include a free-radical polymerization process comprising polymerizing ethylene monomer and optionally (meth) acrylic acid comonomer in the presence of the lubricant composition of any of the first to eleventh aspects via free radical polymerization in a high pressure polyethylene reactor having a compressor with bronze packing rings.

It will be apparent to persons of ordinary skill in the art that various modifications and variations can be made without departing from the scope disclosed herein. Since modifications, combinations, sub-combinations, and variations of the disclosed embodiments, which incorporate the spirit and substance disclosed herein, may occur to persons of ordinary skill in the art, the scope disclosed herein should be construed to include everything within the scope of the appended claims and their equivalents.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter disclosed herein has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

The invention claimed is:

1. A lubricant composition comprising:

an oil lubricant comprising a mineral oil; and a corrosion inhibitor comprising a polymerizable-acid graft polymer comprising from about 3.0% to about 35% by weight of an unsaturated grafting acid and an alkylene oxide polymer backbone, the alkylene oxide polymer backbone having the following formula:

$$R''-[(OC_nH_{2n})_z-OR']_a$$

wherein each R' is independently selected from the group consisting of a hydrogen atom, hydrogen radicals, and acyl radicals;

wherein R" is independently selected from the group consisting of a hydrogen atom, hydrogen radicals, amine-containing radicals, and acyl radicals;

wherein each "n" has, independently, a value of from 2 to 4;

wherein each "Z" has, independently, a value of from 4 to about 1800; and wherein "a" has a value of from 1 to 4.

2. The lubricant composition of claim 1, wherein R' and R" are not both a hydrogen atom.

3. The lubricant composition of claim 1, wherein the grafting acid is selected from the group consisting of acrylic acid, methacrylic acid, itaconic acid, maleic acid, 2-acrylamido-2-methylpropylsulfonic acid (AMPS), 2-methacrylamido-2-methylpropylsulfonic acid, styrene sulfonic acid, vinylsulfonic acid, ethylene glycol methacrylate phosphate, vinyl phosphonic acid and mixtures thereof.

4. The lubricant composition of claim 1, wherein "n"=2 or 3;

wherein "a" has a value of 1;

wherein each R' or R" independently selected from the group consisting of a hydrogen atom, hydrogen radicals, and acyl radicals; and wherein the alkylene oxide polymer backbone is either an ethylene oxide ("EO") or propylene oxide ("PO") polymer.

5. The lubricant composition of claim 1, wherein the alkylene oxide polymer backbone is selected from the group consisting of oxyethylene ("EO") and oxypropylene ("PO").

6. The lubricant composition of claim 1, wherein the alkylene oxide polymer backbone is a copolymer of EO and PO polymers having a weight ratio of from about 0:100 to about 100:0 of EO:PO, or from about 90:10 to about 10:90 of EO:PO, or from about 75:25 to about 25:75 of EO:PO.

7. The lubricant composition of claim 1, wherein the polymer has an average molecular weight between approximately 1500 Daltons and approximately 80000 Daltons.

8. The lubricant composition of claim 1, wherein the grafting acid is acrylic acid (10 wt. %), and the alkylene oxide polymer backbone is poly(oxyethylene-oxypropylene) having a weight ratio of oxyethylene ("EO") to oxypropylene ("PO") of 50:50.

9. The lubricant composition of claim 1, wherein the lubricant composition comprises from 0.5 wt. % to 20 wt. % corrosion inhibitor.

10. A method for reducing corrosion comprising:

exposing a metal component to a solution comprising the lubricant composition of claim 1 and (meth)acrylic acid, wherein the lubricant composition reduces metal corrosion.

11. The method of claim 10, wherein the solution may comprise co-solvent.

12. The method of claim 11, wherein the co-solvent comprises carboxylic acid, alcohol, or combinations thereof.

13. The method of claim 12, wherein the alcohol comprises methanol.

14. The method of claim 11, wherein the metal component comprises bronze packing rings.

15. The method of claim 14, wherein the bronze packing rings are part of a compressor.

16. The method of claim 15, wherein the bronze packing rings are part of a compressor unit utilized in a high pressure polyethylene reactor.

17. A free-radical polymerization process comprising:

polymerizing ethylene monomer and optionally (meth) acrylic acid comonomer in the presence of the lubricant composition of claim 1 via free radical polymerization in a polyethylene reactor having a compressor with bronze packing rings and at a pressure of at least 100 MPa.

* * * * *